US007571501B2

(12) United States Patent
Jansen et al.

(10) Patent No.: US 7,571,501 B2
(45) Date of Patent: Aug. 11, 2009

(54) DEVICE FOR RECEIVING AT LEAST ONE MATTRESS FOR BEDS, COTS OR THE LIKE

(75) Inventors: Klaus Jansen, Buxtehude (DE); Dietmar Weidler, Bremervörde (DE)

(73) Assignee: Thomas GmbH + Co. Technik + Innovation KG, Bremervorde (DE)

( * ) Notice: Subject to any disclaimer, the term of this patent is extended or adjusted under 35 U.S.C. 154(b) by 292 days.

(21) Appl. No.: 11/539,183

(22) Filed: Oct. 6, 2006

(65) Prior Publication Data

US 2007/0113343 A1 May 24, 2007

(30) Foreign Application Priority Data

Oct. 12, 2005 (DE) ..... 20 2005 016 193 U

(51) Int. Cl.
*A61G 7/015* (2006.01)

(52) U.S. Cl. ..... 5/618

(58) Field of Classification Search ..... 5/618, 5/617, 613

See application file for complete search history.

(56) References Cited

U.S. PATENT DOCUMENTS 651,378 A 6/1900 Nicholls
727,467 A 5/1903 Sennett
1,055,241 A 3/1913 Terry
3,132,351 A 5/1964 Huntress et al.

FOREIGN PATENT DOCUMENTS

CH 149 563 A 9/1931
DE 36 18 680 C2 6/1986
DE 298 00 094 U1 2/1998

OTHER PUBLICATIONS

EP Search Report No. 06 01 9639 dated Feb. 8, 2007.

*Primary Examiner*—Alexander Grosz
(74) *Attorney, Agent, or Firm*—Laurence P. Colton; Smith, Gambrell & Russell

(57) ABSTRACT

The invention provides as a connecting element at least one flexural pull element (29) disposed between the pivotable back element (13) and leg element (15) of the support (12). Such a flexural pull element, which can be a cord or belt, for example, can be arranged in a space-saving manner under the support (12) and integrated in a frame (11) of the bed or cot. Thus, no space is taken up by the pull element beneath the frame (11). The invention thereby provides a connecting element of simple and space-saving design which allows for the simultaneous pivoting of the back element (13) and leg element (15) of the support (12).

18 Claims, 2 Drawing Sheets

DEVICE FOR RECEIVING AT LEAST ONE MATTRESS FOR BEDS, COTS OR THE LIKE

STATEMENT OF RELATED APPLICATIONS

This patent application claims convention priority on German Patent Application No. 20 2005 016 193.4 having a filing date of 12 Oct. 2005, which is incorporated herein by this reference.

BACKGROUND OF THE INVENTION

1. Technical Field

The invention relates to a device for receiving at least one mattress for beds, cots or the like, with a frame and a support, assigned to the frame, for the at least one mattress, the support having at least one back element and one leg element which are coupled pivotably and by at least one connecting element in order to pivot the leg element simultaneously when the back element is pivoted.

2. Related Art

The comfort of beds and cots has to meet increasingly exacting requirements. This applies to all areas in which beds and cots are used, namely in hospitals, homes for the elderly or the like, in camping vehicles and also in lorry cabs as well in addition to the conventional use in home and hotel.

A care bed, which has a support of multipart design for lying and resting, is known from DE 36 18 680 C2. A back element and a leg element of the support are mounted pivotably on a frame. The back element and leg element are interconnected via a connecting element, which allows simultaneous pivoting of back element and leg element. In this connection, the connecting element consists of a lever arm and an actuating lever which, although articulated flexibly to the back element and leg element, are otherwise of rigid design.

A disadvantage of this prior art is the complicated constructional design of the connecting element, which also has a large space requirement because, in particular when the back element is not raised, the connecting element protrudes considerably under the frame. For cramped space conditions, above all in lorries, this known bed is therefore unsuitable.

It is an object of the invention to provide a device for receiving at least one mattress for beds, cots or the like which allows simultaneous pivoting of back part and leg part by virtue of a space-saving connecting element of simple construction.

BRIEF SUMMARY OF THE INVENTION

The object is achieved by a device for receiving at least one mattress for in particular beds or cots, with a frame and a support, assigned to the frame, for the at least one mattress, the support having at least one back element and one leg element which are coupled pivotably and by at least one connecting element in order to pivot the leg element simultaneously when the back element is pivoted, characterized in that the connecting element is designed as at least one pull element. The connecting element is designed as at least one pull element, by virtue of which it can be integrated into the frame in flaccid form. The space below the frame is not taken up by the pull element, so that the device according to the invention does not require any additional space for the at least one pull element.

According to a preferred development of the invention, one end of the at least one pull element is articulated on the back element and an opposite end of the at least one pull element is articulated on the leg element. The pull element transmits the tensile forces resulting from the pivoting of the back element directly to the leg element, by virtue of which this can be moved accordingly.

According to an especially advantageous development of the invention, the movement of the back element and of the leg element is synchronized by the at least one pull element. When the back element is raised from a starting position, the leg element likewise has its position changed. Consequently, only one manual operation is necessary in order to transfer the support from a position for lying into a position for sitting and vice versa.

In an advantageous development, the leg element is of multipart design, preferably consisting of a shank element and a thigh element, which are interconnected via at least one articulation. The two part elements are dimensioned in such a way that the or each articulation connecting the two part elements lies approximately under the knee joints of the legs resting thereon.

According to a preferred development of the invention, a free outer end of the shank element is displaceable in relation to the frame, preferably along the plane of the frame. The shank element lies at least in part in the plane of the frame and is moved out of this during pivoting, the free outer end remaining in the plane of the frame. In this connection, the free outer end is preferably not articulated on the frame or connected to it in a similar way. If appropriate, the free outer end lies in the frame on a guide, rail or the like.

According to an advantageous development of the invention, the at least one pull element is connected to the shank element, in particular to the free outer end thereof. When the back element is raised, the tensile forces of the pull element act on the free outer end of the shank element and cause this free end to be displaced in the plane of the frame.

In a further development of the device, the at least one pull element is assigned to the back element and the shank element in such a way that, when the back element is pivoted up, the at least one articulation between the shank element and the thigh element is simultaneously raised. By virtue of this, the thigh element and the shank element pivot in opposite directions and correspond in a lateral view to an inverted "V". The legs rest in each case on the thigh element and shank element assigned to them, which elements together and in conjunction with the inclined back element bring about a pleasant rest position, which relieves the spinal column.

The at least one pull element is advantageously designed as a rope, a belt, a chain or the like of essentially constant length. By virtue of this, it is designed as a cost-effective connecting element and can be integrated compactly into the device in various ways.

For pivoting the leg element consisting of shank element and thigh element from a raised position into a starting position, at least one resiliently length-adjustable restoring means, preferably a rubber rope, a tension spring, a gas pressure spring or the like, is provided between the frame and the leg element, preferably the shank element. The or each restoring means is assigned to the frame and the leg element, or the shank element, in such a way that no forces are transmitted to the frame and the shank element by the restoring means in the starting position of the leg element, or the shank element. That end of the at least one restoring means assigned to the frame lies in the region of the free outer end of the shank element, whereas the end assigned to the leg element consisting of shank element and thigh element is fastened in the region of the articulation between the thigh element and shank element. The tensile force of the at least one resilient, length-adjustable restoring means counteracting pivoting-up of shank element and thigh element is small in the initial phase of the movement from the flat starting position and increases continuously with increasing pivoting of the shank element. This arrangement permits comparatively easy pivoting-up of the back element and the leg element consisting of thigh element and shank element, which requires little effort. When the back element is pivoted into the flat starting position, the pull element relaxes, by virtue of which it cannot move the leg element back into the flat starting position. This function is performed by the or each restoring means, which pulls the leg element back into the starting position.

In an advantageously designed device, the back element can be locked in at least one pivoted-up position. Locking the back element causes the thigh element and shank element likewise to be held in a corresponding position by the pull element. The back element can preferably be locked in various positions, by virtue of which the pivoting height of the articulation between the thigh element and shank element can likewise be locked at various heights.

In a development of the device according to the invention, the support has a trunk element, the back element preferably being articulated pivotably on one end of the trunk element and the thigh element preferably being articulated pivotably on another end of the trunk element. The trunk element is designed to be approximately of such a size that the back and the legs are advantageously supported by the elements assigned to them.

BRIEF DESCRIPTION OF THE DRAWINGS

Preferred illustrative embodiments of the invention are explained in greater detail below with reference to the drawing, in which.

DETAILED DESCRIPTION OF PREFERRED EMBODIMENTS

Figure 1:
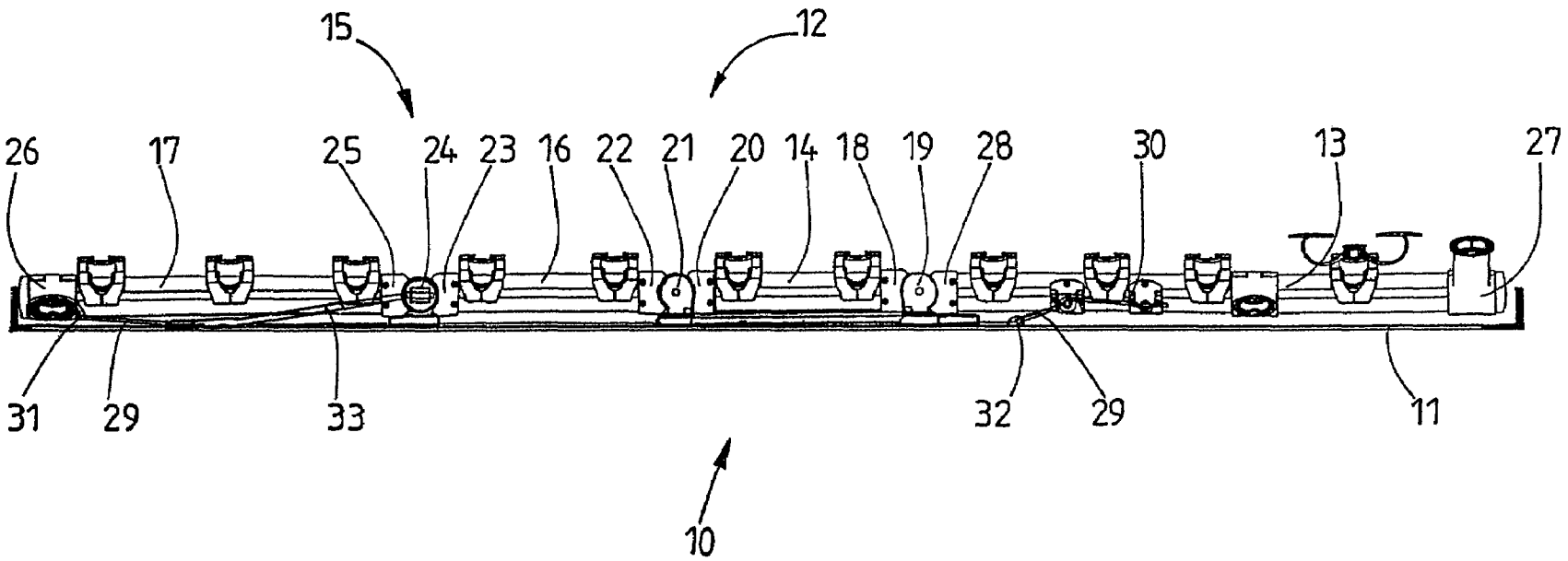
FIG. 1 shows a side view of the device in the flat starting position.
Figure 2:
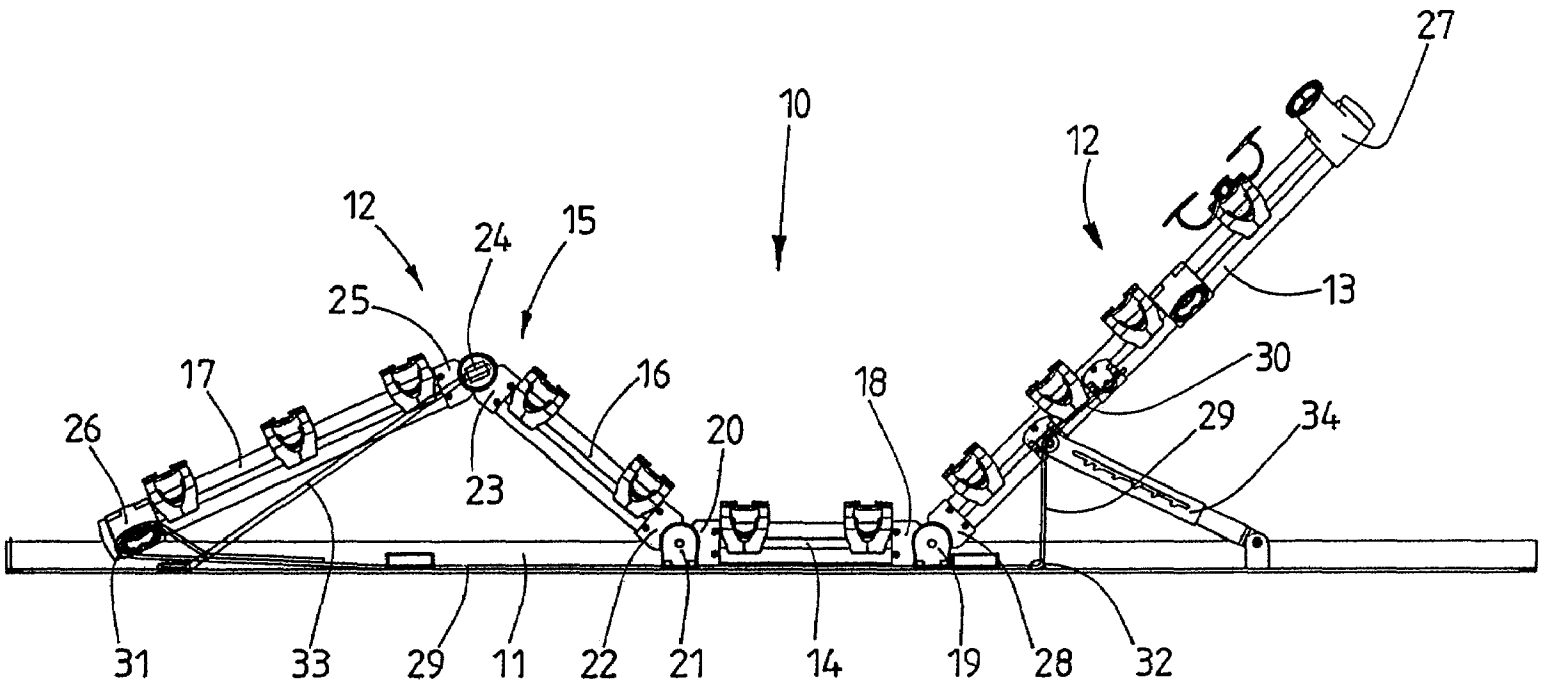
FIG. 2 shows a side view of the device in the pivoted-up position.

The device 10 illustrated in the figures has a frame 11 with a support 12 for, for example, a mattress (not shown). The support 12 is of multipart design, parts of the support 12 being assigned to the frame 11 in such a way that at least some of the parts are pivotable. The support 12 has a back element 13, a leg element 15 and, in the illustrative embodiment shown, a trunk element 14. However, a support 12, which does not have a trunk element 14, is also conceivable within the scope of the invention. The leg element 15 is formed from a thigh element 16 and a shank element 17. The relation of the parts elements 13, 14, 15, 16, 17 of the support 12 corresponds to the human body, so that the trunk element 14 is bounded by the back element 13 and the leg element 15 consisting of thigh element and shank element 16, 17. The trunk element 14 is fixed, in particular non-displaceable. The trunk element 14 is preferably connected non-displaceably to the frame 11. One end 18 of the trunk element 14 has an articulation 19, on which the back element 13 is movably articulated. The back element 13 has two ends 27 and 28, of which the end 28 is connected to the articulation 19 and the end 27 has no connection to the frame 11 and is freely movable. Another end 20 of the trunk element 14 likewise has an articulation 21, on which the leg element 15 is movably articulated with one end 22 of the thigh element 16. An opposite end 23 of the thigh element 16 has an articulation 24, on which one end 25 of the shank element 17 is movably articulated. A free end 26 of the shank element 17 is freely displaceable in relation to the frame 11 in the longitudinal direction thereof and accordingly has no connection to the frame 11.

In a starting position, the part elements 13, 14, 16, 17 are located approximately in a plane (FIG. 1), by virtue of which a preferred position suitable for sleeping is brought about. In this flat starting position, the support 12 lies at least in part in a preferably horizontal plane extending through the frame 11. For a resting or sitting position, at least some of the part elements 13, 16, 17 are mounted movably and so as to be capable of being pivoted up out of the plane of the frame 11 in the region of the frame 11, in particular thereon.

The back element 13 and leg element 15, consisting of thigh element 16 and shank element 17, are coupled by a connecting element which is designed as a simple pull element 29. However, it is also conceivable to provide a number of preferably parallel pull elements 29. The pull element 29 is connected firmly to the back element 13 in the region between the articulation 19 and the free end 27 of the back element 13. The distance of the connection location of the pull element 29 on the back element 13 from the articulation 19 is selected in a way appropriate to the requirements for mobility of the leg element 15. This distance sets the amount by which the leg element 15 is moved, in particular bent when the back element 13 is pivoted. The greater the distance of the fastening point of the pull element 29 from the articulation 19, the more the leg element 15 is moved, that is the shank element 17 and the thigh element 16 are bent, when the back element 13 is pivoted. Another free end 31 of the pull element 29 is articulated on the free outer end 26 of the shank element 17. In the flat starting position of the support 12, the pull element 29 extends for the most part approximately parallel to the part elements 13, 14, 16, 17. By virtue of the back element 13 being pivoted up, tensile forces are exerted by the pull element 29 on the shank element 171 in particular the free outer end 26 thereof. As a result, the pull element 29 pulls the free outer end 26 of the shank element 17 in the direction of the back element 13.

Displacement of the free end 26 of the shank element 17 gives rise to pressure forces which act on the articulation 24 between the shank element 17 and the thigh element 16. Owing to this force introduction, the articulation 24 is moved out of the plane of the frame 11 and pivoted up with the ends 23, 25 of the thigh element 16 and the shank element 17 which are brought together at the articulation 24, as a result of which the leg element 15 is bent at the articulation 24. In this connection, the end 22 of the thigh element 16 and the free end 26 of the shank element 17 remain in the plane of the frame 11. With the articulation 24 raised, the two part elements 16, 17 consequently project at an angle to one another in opposite directions and at least in part out of the plane. In this position, the thigh element 16 and the shank element 17 describe an inverted V, the angle between the thigh element and shank element 16, 17l varying as a function of the position of the back element 13. The height by which the articulation 24 is raised in relation to the frame 11 is dependent on the pivoting angle of the back element 13. The further the back element 13 is pivoted upwards, the further the pull element 29 pulls the free end 26 of the shank element 17 in the direction of the back element 13 and pushes the articulation 24 with the articulated thigh element 16 and shank element 17 upwards.

The pull element 29 is of flexible design, preferably in the form of a rope, belt, chain or the like. In this connection, the flaccid pull element 29 is inelastic or virtually unyielding, so that the pull element 29 transmits the pivoting travel of the back element 13 directly and unchanged to the free end 26 of the shank element 17.

In the illustrative embodiment shown, a deflecting means 32 arranged at a spacing from the articulation 19 is connected firmly to the frame 11. On the deflecting means 32, preferably designed as a deflecting roller, the pull element 29 is deflected below the back element 13. That portion of the pull element 29 located between the deflecting means 32 and the back element 13 extends vertically or at an angle above the plane of the frame 11. From the deflecting means 32 to the shank element 17, the pull element 29 extends approximately horizontally next to or below the support 12. In this way, the pull element 29 is located within the outlines of the frame 11 and the support 12. Consequently, the pull element 29 does not project outwards in relation to the outlines of the frame 11 and the support 12, as a result of which it requires no additional space and is essentially invisible. When the back element 13 is pivoted up, that end of the pull element 29 connected to the shank element 17 is moved in the direction of the back element 13. That part of the pull element 29 lying in the plane of the frame 11 is thus shortened. The result is that the articulation 24 is raised and the leg element 15 is bent. If required, further deflecting means (not shown) are arranged on the frame 11 and/or on the support 12.

When the back element 13 is pivoted back into a lower position, or into the flat starting position, the pull element 29, which is acting on the free end 26 of the shank element 17 with the tensile forces, relaxes. The end 26 of the shank element 17 is consequently free and can be moved back in the direction of one end 35 of the frame 11 again by the length the pull element 29 has relaxed. In the case of the back element 13 being pivoted back into the flat starting position, the entire leg element 15 can accordingly also be moved back into the starting position.

When a person is resting on the device 10, the leg element 15 is as a rule moved back into a position corresponding to the back element 13 during pivoting back by the weight of the legs lying thereon. In particular in the case of the support 12 not being loaded, but also if the weight is not sufficient in order to bring the thigh element and shank element 16, 17 into the flat starting position, at least one restoring means 33 is assigned to the leg element 15. The restoring means 33 is articulated with in each case one end on the frame 11 and the leg element 15, preferably the articulation 24, and designed to be resiliently length-adjustable. To this end, the restoring means concerned is designed in the manner of a rubber spring, for example as a rubber rope or rubber strand, but if appropriate also as a tension spring or gas pressure spring. The articulation points of the restoring means 33 are assigned to the articulation 24 and the frame 11 in such a way that, in the starting position, the restoring means 33 rises in the direction of the articulation 24 only slightly in relation to the horizontal. The articulation point is preferably arranged on the inner side of the articulation 24 and at a spacing from that side of the frame 11 facing outwards. However, it is also conceivable to assign the restoring means to other locations on the leg element 15 and/or the frame 11.

In the flat starting position of the leg element 15, the restoring means 33 has a starting length that, in the illustrative embodiment, corresponds to the distance between the two articulation points. In this connection, the restoring means 33 can be unloaded or slightly elastically pretensioned. When the back element 13 is pivoted up and the articulation 24 is simultaneously raised, the length of the restoring means 33 is increased and this increases the tension in the resilient restoring means 33. As a result, with the articulation 24 raised, increasing tensile forces act on it in the downward direction.

In the starting position of the support 12, the articulation points of the restoring means 33 on the frame 11 and the articulation 24 lie at a spacing from one another virtually in the plane of the frame 11. By virtue of this, the restoring means 33 is stretched only a little with a small pivoting travel of the leg element 15 out of the starting position, so that correspondingly smaller tensile forces act on the articulation 24 and therefore on the back element 13. These tensile forces of the restoring means 33 become greater with increasing upward movement of the articulation 24 and pull the thigh element 16 and the shank element 17 downwards into a lower position as soon as the back element 13 is pivoted back.

A locking means 34 that holds the back element 13 in a pivoted-up position is arranged between the back element 13 and the frame 11. The locking means 34 preferably makes a number of defined pivoting positions of the back element 13 possible, a locking means 34 with sliding transitions also being possible. By locking the back element 13 in a pivoted-up position, the leg element 15 is simultaneously fixed in a corresponding position by the pull element 29 connecting the back element 13 to the leg element 15. With the release of this locking, the leg element 15 can also be pivoted again.

The functioning of the device 10 is described in greater detail below.

In the starting position of the support 12, the pull element 29, which interconnects the back element 13 and the leg element 15, lies flaccid or slightly taut between the two elements 13 and 15. In this position, virtually no tensile forces are transmitted to the end 26 of the shank element 17 from the back element 13. During initial raising of the back element 13, the pull element 29 is subjected to tensile stress. As the pivoting-up of the back element 13 continues, tensile forces are exerted on the end 26 of the shank element 17 because that part of the pull element 29 located in the plane of the frame 11 is shortened. As a result, the free end 26 of the shank element 17, which is mounted freely displaceably in the plane of the frame 11, is displaced in the direction of the back element 13. In this connection, pressure forces act on the articulation 24 between the shank element 17 and the thigh element 16, as a result of which the articulation 24 is pushed up by the forces acting on it. By virtue of this, the leg element 15 is bent in the center, that is between the thigh element 16 and the shank element 17, at the articulation 24, as a result of which the leg element 15 takes on the shape of an inverted "V". The angle between the thigh element 16 and the shank element 17 is dependent on the length by which the end 26 is displaced in the plane of the frame 11 by the pull element 29. Similarly, the height by which the articulation 24 is raised is therefore dependent on the pivoting angle of the back element 13.

The connection, designed as a simple pull element 29, between back element 13 and leg element 15 synchronizes the movement sequences of the leg element 15 with the pivoting-up of the back element 13. When the back element 13 is put back, no forces are transmitted to the leg element 15 via the pull element 29. Rather, the pull element 29 is extended, as a result of which the tensile forces that have thus far acted on the end 26 of the shank element 17 decrease. It is thus possible to push the end 26 of the shank element 17 back, in particular away from the back element 13. Pushing the end 28 of the shank element 17 back and simultaneously lowering the back element 13 and the articulation 24 in the leg element 15 brings the support 12 back into the flat starting position.

Lowering the articulation 24 with the thigh element 16 and shank element 17 in the direction of the frame 11 cannot take place automatically with an unloaded support 12. The at least one resilient restoring means 33 is therefore assigned to the leg element 15. In the starting position of the support 12, the restoring means 33 lies, rising slightly at an angle to the articulation 24, in the plane of the frame 11 and has a starting length. At this starting length, no forces or only small tensile forces are transmitted from the restoring means 33 to the articulation 24. Only by raising the back element 13 and simultaneously moving the articulation 24 up in relation to the frame 11 is the restoring means 33 tensioned, as a result of which the resilient properties are activated, in particular increase gradually. Owing to the particular arrangement of the restoring means 33 between the frame 11 and the leg element 15, the tensile forces that act on the articulation 24 are small to begin with. Only with an increase in the distance of the articulation 24 from the frame 11 is the restoring means 33 stretched further, as a result of which the tensile forces which, directed downwards, act on the articulation 24 increase. The force with which the restoring means 33 counteracts raising of the back element 13 is consequently small during initial raising of the back element 13. Only with increasing raising of the back element 13 does the restoring means 33 exert increasing force counter to the raising direction of the back element 13. However, this force is not so great that it appreciably affects raising of the back element 13.

When the back element 13 is pivoted back, in which connection the flaccid pull element 29 cannot exert any restoring force on the leg element 15, the restoring means 33 generates a force which acts downwards on the articulation 24 between the thigh element 16 and the shank element 17 and has a vertically downwardly directed force component which pulls the articulation downwards, in particular into the starting position, in which the leg element 15 again lies virtually horizontally. The restoring means 33 consequently brings about synchronization of the movement of the leg element 15 with the pivoting-back of the back element 13 because the vertical force component exerted by the restoring means 33 on the articulation 24 keeps the pull element 29 under tension and the articulation 24 is thus lowered similarly to the pivoting-back of the back element 13 during the relaxation of the pull element 29 brought about by the pivoting-back of the back element 13.

If the back element 13 is locked in the desired pivoting position by the locking means 34, locking of the position of the leg element 15, which corresponds to the (desired) inclination of the back element 13 fixed by the locking means 34, is also brought about automatically by the pull element 29 of essentially constant length.

LIST OF DESIGNATIONS

| | |
|---|---|
| 10 | device |
| 11 | frame |
| 12 | support |
| 13 | back element |
| 14 | trunk element |
| 15 | leg element |
| 16 | thigh element |
| 17 | shank element |
| 18 | end (14) |
| 19 | articulation |
| 20 | end (14) |
| 21 | articulation |
| 22 | end (16) |
| 23 | end (16) |
| 24 | articulation |
| 25 | end (17) |
| 26 | free end (17) |
| 27 | free end (13) |
| 28 | end (13) |
| 29 | pull element |
| 30 | free end (29) |

-continued

| | |
|---|---|
| 31 | free end (29) |
| 32 | deflecting means |
| 33 | restoring means |
| 34 | locking means |

What is claimed is:

1. A device for receiving at least one mattress for beds or cots, comprising a frame (11) and a support (12), the frame (11), and the support (12) for supporting the at least one mattress, wherein:

the support (12) comprises at least one back element (13) and one leg element (15) which are coupled pivotably and by at least one connecting element in order to pivot the leg element (15) simultaneously when the back element (13) is pivoted, the connecting element is at least one pull element (29), the leg element (15) is a multipart structure comprising a shank element (17) and a thigh element (16), which are interconnected via at least one articulation (24).

2. The device according to claim 1, wherein one end (30) of the at least one pull element (29) is articulated on the back element (13) and an opposite end (31) of the at least one pull element (29) is articulated on the leg element (15).

3. The device according to claim 2, wherein movement of the back element (13) and of the leg element (15) is synchronized by the at least one pull element (29) whereby when the back element (13) is raised from a starting position, the leg element (15) position is changed.

4. The device according to claim 1, wherein movement of the back element (13) and of the leg element (15) is synchronized by the at least one pull element (29) in that, when the back element (13) is raised from a starting position, the leg element (15) can have its position changed.

5. The device according to claim 1, wherein a free outer end (26) of the shank element (17) is displaceable in relation to the frame (11).

6. The device according to claim 1, wherein the at least one pull element (29) is connected to the shank element (17).

7. The device according to claim 6, wherein the at least one pull element (29) is connected to a free outer end (26) of the shank element (17).

8. The device according to claim 1, wherein the at least one pull element (29) cooperates with the back element (13) and the shank element (17) such that, when the back element (13) is pivoted up, the at least one articulation (24) between the shank element (17) and the thigh element (16) is simultaneously raised for pivoting the thigh element (16) and the shank element (17) in opposite directions.

9. The device according to claim 1, wherein the at least one pull element (29) is of constant length and is selected from the group consisting of ropes, belts, and chains.

10. The device according to claim 1, further comprising at least one resiliently length-adjustable restoring means (33) located between the frame (11) and the leg element (15).

11. The device according to claim 1, wherein the back element (13) is lockable in at least one position different from a starting position.

12. The device according to claim 1, wherein the support (12) has a trunk element (14).

13. The device according to claim 12, wherein the back element (13) is articulated pivotably on one end of the trunk element (14) and the thigh element (16) is articulated pivotably on another end (20) of the trunk element (14).

14. A device for receiving at least one mattress for beds or cots, comprising a frame (11) and a support (12), the frame (11) and the support (12) for supporting the at least one mattress, and at least one resiliently length-adjustable restoring means (33), wherein:

the support (12) comprises at least one back element (13) and one leg element (15) which are coupled pivotably and by at least one connecting element in order to pivot the leg element (15) simultaneously when the back element (13) is pivoted, the connecting element is at least one pull element (29), the at least one resiliently length-adjustable restoring means (33) is located between the frame (11) and the leg element (15), and one end of the at least one resiliently length-adjustable restoring means (33) is articulated on or close to an articulation (24) between the shank element (17) and the thigh element (16) of the leg element (15).

15. A device for receiving at least one mattress for beds or cots, comprising a frame (11) and a support (12), the frame (11) and the support (12) for supporting the at least one mattress, and at least one resiliently length-adjustable restoring means (33), wherein:

the support (12) comprises at least one back element (13) and one leg element (15) which are coupled pivotably and by at least one connecting element in order to pivot the leg element (15) simultaneously when the back element (13)is pivoted, the connecting element is at least one null element (29), the at least one resiliently length-adjustable restoring means (33) is located between the frame (11) and the leg element (15), and the at least one resiliently length-adjustable restoring means (33) exerts a downwardly directed tensile force on the leg element (15).

16. The device according to claim 15, wherein the at least one resiliently length-adjustable restoring means (33) exerts a downwardly directed tensile force on an articulation (24) of the leg element (15).

17. A device for receiving at least one mattress for beds or cots, comprising a frame (11) and a support (12), the frame (11) and the support (12) for supporting the at least one mattress, and at least one resiliently length-adjustable restoring means (33), wherein the support (12) comprises at least one back element (13) and one leg element (15) which are coupled pivotably and by at least one connecting element in order to pivot the leg element (15) simultaneously when the back element (13) is pivoted, the connecting element is at least one pull element (29), the at least one resiliently length-adjustable restoring means (33) is located between the frame (11) and the leg element (15), and the at least one resiliently length-adjustable restoring means (33) is fastened between the frame (11) and the leg element (15) such that the at least one resiliently length-adjustable restoring means (33) is inclined at least slightly in relation to the horizontal in all positions of the leg element (15), including a flat starting position thereof.

18. A device for receiving at least one mattress for beds or cots, comprising a frame (11) and a support (12), the frame (11) and the support (12) for supporting the at least one mattress, and at least one resiliently length-adjustable restoring means (33), wherein:

the support (12) comprises at least one back element (13) and one leg element (15) which are coupled pivotably and by at least one connecting element in order to pivot the leg element (15) simultaneously when the back element (13) is pivoted, the connecting element is at least one null element (29), the at least one resiliently length-adjustable restoring means (33) is located between the frame (11) and the leg element (15), and the at least one resiliently length-adjustable restoring means (33) is an elastically longitudinally extensible rubber spring.

* * * * *